United States Patent [19]

Lieder

[11] 4,214,417

[45] Jul. 29, 1980

[54] BAG TOP FORMING AND RETAINING APPARATUS

[75] Inventor: Gaylerd M. Lieder, Minneapolis, Minn.

[73] Assignee: Bemis Company, Inc., Minneapolis, Minn.

[21] Appl. No.: 14,055

[22] Filed: Feb. 22, 1979

[51] Int. Cl.[2] ..... B65B 7/06

[52] U.S. Cl. ..... 53/371

[58] Field of Search ..... 53/371, 372, 373, 138 A, 53/139

[56] References Cited

U.S. PATENT DOCUMENTS

| | | | |
|---|---|---|---|
| 3,167,897 | 2/1965 | Hopkins et al. | 53/371 X |
| 3,896,605 | 7/1975 | Chevalier | 53/371 X |
| 4,078,358 | 3/1978 | Henderson | 53/373 X |
| 4,098,054 | 7/1978 | Cerioni | 53/371 X |

FOREIGN PATENT DOCUMENTS

| | | | |
|---|---|---|---|
| 567633 | 9/1977 | U.S.S.R. | 53/371 |

*Primary Examiner*—Horace M. Culver
*Attorney, Agent, or Firm*—Clayton R. Johnson

[57] ABSTRACT

For retaining the bag top of a filled bag in an upright aligned condition as the filled bag is dropped onto a filled bag conveyor after having been clamped to a spout assembly and being conveyed to a bag top closure machine, bag top forming and retaining apparatus that includes a longitudinally elongated pivot member pivotally mounted on the frame and mounting a pair of fingers for pivotal movement therewith and pivotal movement relative thereto between a spread apart (out) position and a together "in" position, a piston cylinder subassembly for pivoting the pivot member to elevate the fingers to a position to drop into the bag mouth portion when the bag is clamped on the spout and the fingers are in their in position, thus allow the fingers to drop to an intermediate elevation to extend into the bag, and when the filled bag is released by the spout, move to a lower elevation to remain in the bag, a swing arm conveyor assembly, and control means to move the fingers to their out position when the fingers are at their intermediate elevation and thus move the fingers to their in position and operate the piston cylinder subassembly to elevate the fingers out of the bag after the swing arm conveyor assembly has conveyingly engaged at least the bag top leading edge portion.

24 Claims, 5 Drawing Figures

BAG TOP FORMING AND RETAINING APPARATUS

BACKGROUND OF THE INVENTION

Bag top forming and retaining apparatus for forming the bag top of a filled bag for movement through a bag top closure machine.

In the prior art plastic bags are clamped to a spout assembly, filled, and then dropped onto a conveyor assembly which conveys the filled bag through a bag top closure machine, for example a heat sealing machine. Problems have been encountered in that as the filled bag is being conveyed to a bag top closure machine at times the bag top is not properly aligned, or remains aligned until it enters the closure machine conveyor, or properly shaped to be passed through the bag top closing machine; or if it passes through the closing machine, the desired bag top closure is not obtained without the intervention of an operator. In order to overcome problems of the above mentioned nature, this invention has been made.

SUMMARY OF THE INVENTION

Bag top forming and retaining apparatus that includes a pair of fingers, means for elevating the fingers above the bag mouth of a bag, thence allow the fingers to drop to extend into the bag mouth and move the fingers apart to form the bag top, and thereafter move the fingers toward one another and move the fingers out of the bag, and a bag top conveyor assembly having swing arm mounted conveyor belts to conveyingly abut against opposite bag top side wall portions while the fingers are in their apart condition extending into the bag mouth.

One of the objects of this invention is to provide new and novel means for forming the mouth portion of a bag and retaining the bag top in a desired formed condition while the bag in a filled condition is conveyed to have the bag top portion enter into a bag top closure machine. Another object of this invention is to provide new and novel means extendable into the bag mouth portion to form the bag top and retain the bag top in a formed condition as the bag falls from a hopper spout clamped position to a filled bag conveyor. In furtherance of the last mentioned object it is another object of this invention to provide new and novel means for conveyingly engaging the formed bag top while the bag is positively retained in a formed condition and is on the filled bag conveyor.

A further object of this invention is to provide new and novel means for moving fingers for shaping a bag top and mounting the fingers for movement to remain in a bag top shaped position as the bag moves to a lower elevation.

BRIEF DESCRIPTION OF THE DRAWINGS

FIG. 1 is a plan view of the apparatus of this invention with the bag top conveyor swing arms and the fingers being shown in solid lines in a position that the bag has been dropped on a filled bag conveyor to be conveyed to a bag top closure machine, and in dotted lines in a position that a bag is being filled. Parts are broken away and the position of the spout assembly when in a position for dropping a bag onto a filled bag conveyor is diagrammatically illustrated in dotted lines;

Figure 2:
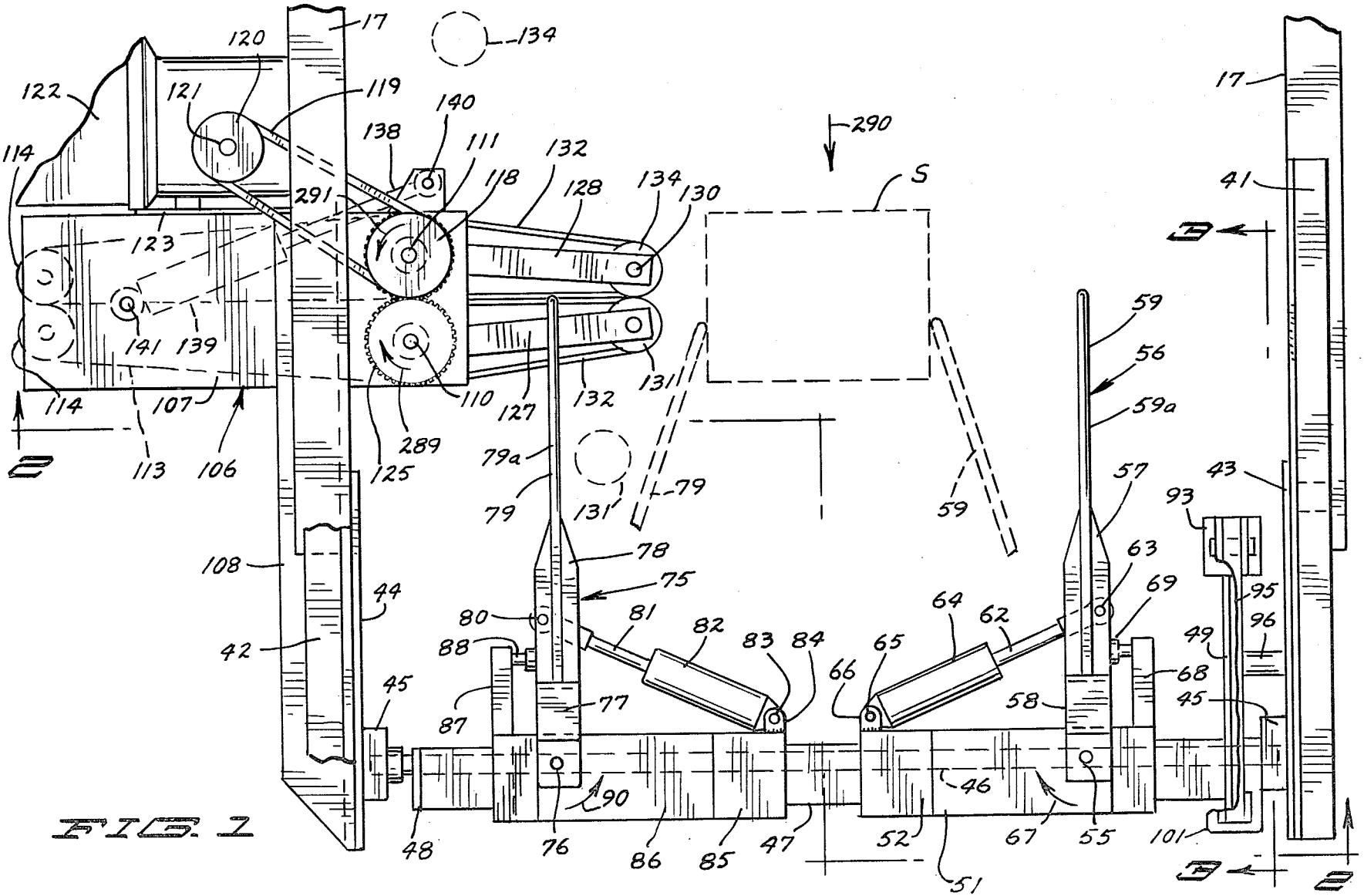
FIG. 2 is a fragmentary end view of the apparatus of this invention with transverse intermediate portions broken away, said view being generally taken along the line and in the direction of the arrows 2—2 of FIG. 1.
Figure 2:
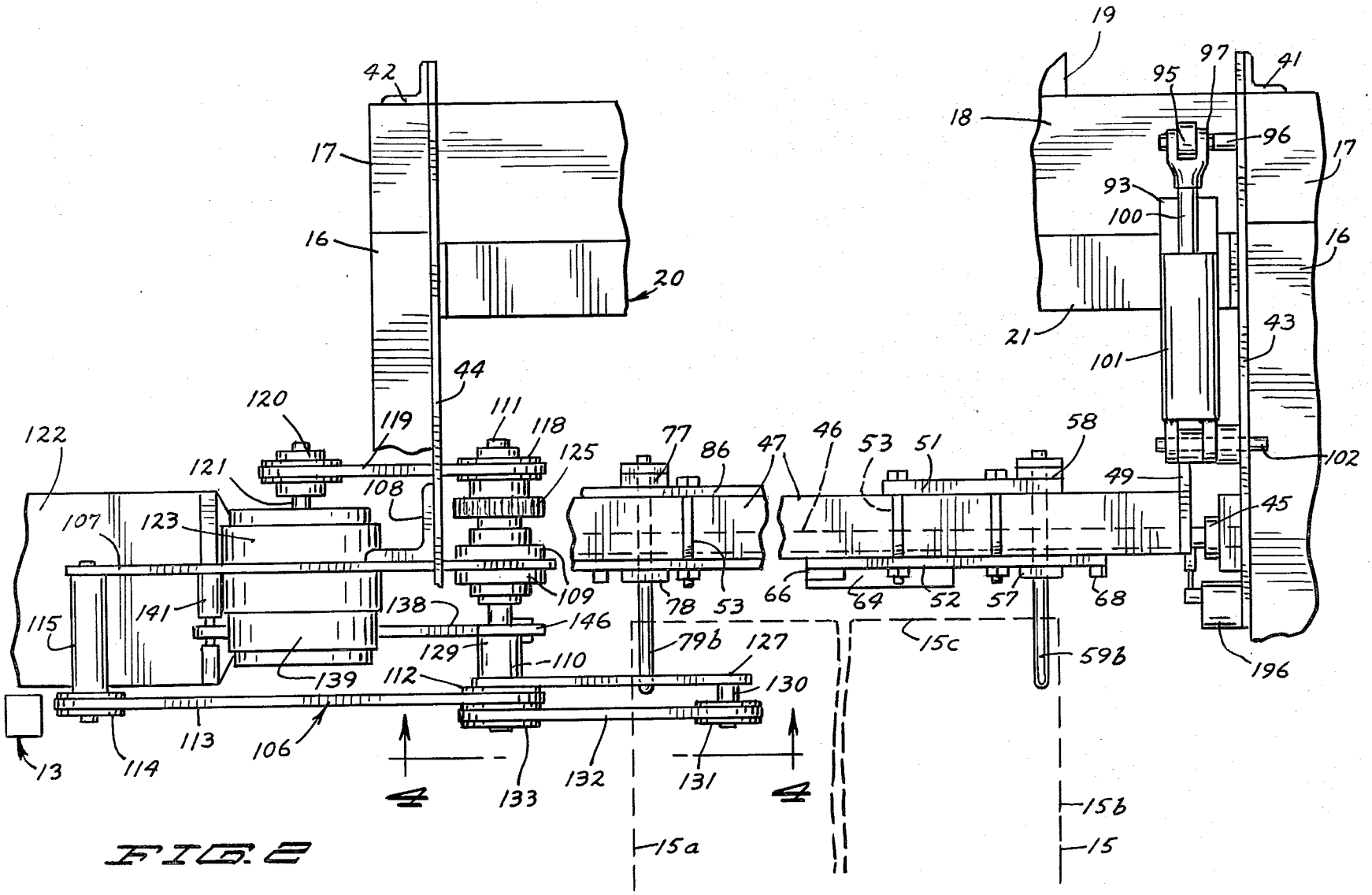
Figure 3:
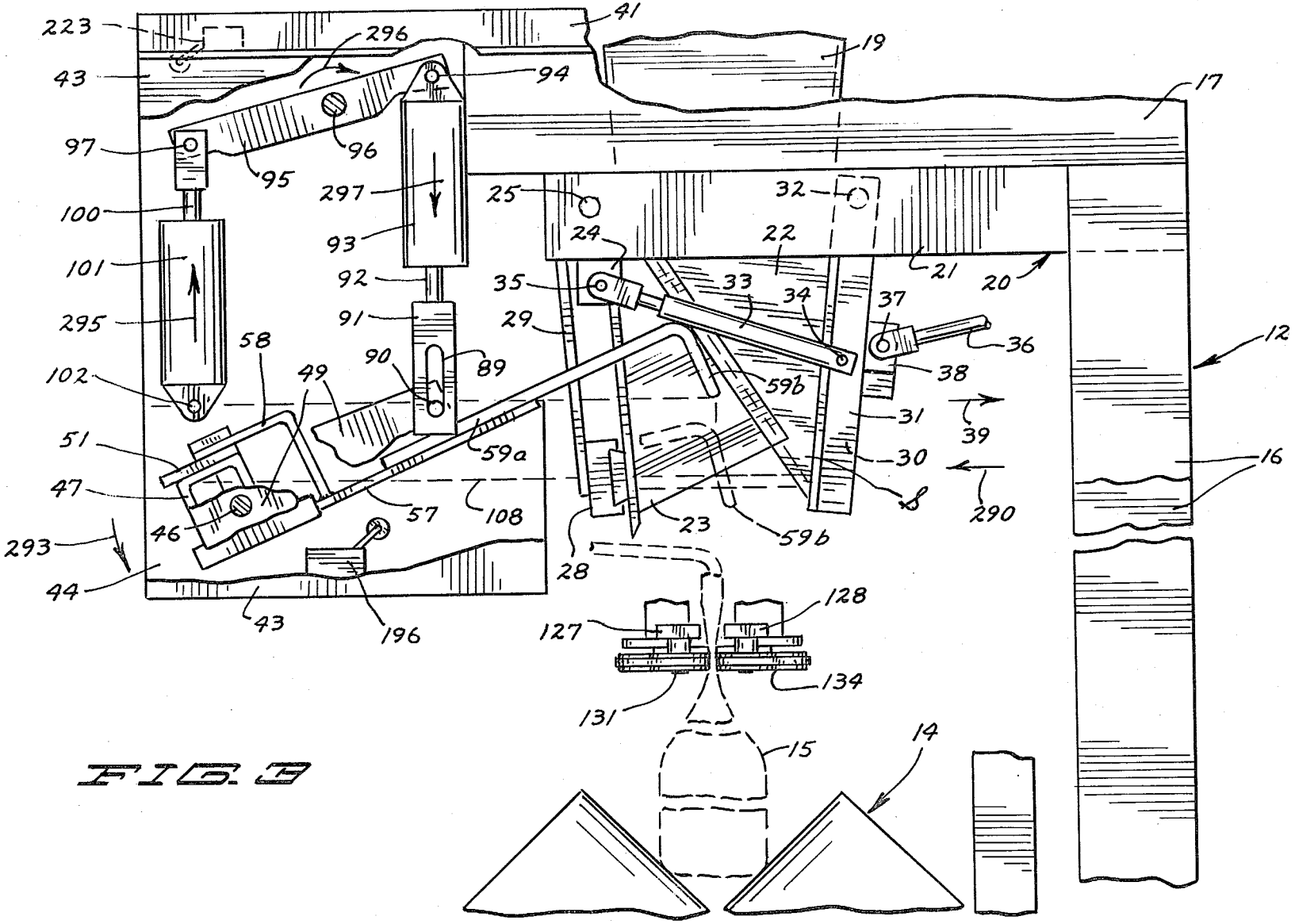
FIG. 3 is a side view of the apparatus of this invention together with a fragmentary portion of the bag filling machine being shown with the spout thereof in overhanging relationship to a filled bag conveyor, said view being generally taken along the line and in the direction of the arrows 3—3 of FIG. 1 other than the finger assemblies are shown in an elevated position in solid lines and portions of the frame are shown, and a finger intermediate elevated position and a finger lowered position are shown in dotted lines.

Referring now in particular to FIGS. 1–3, the apparatus of this invention, generally designated 10, is used to form and retain a bag top properly shaped as a bag 15 is filled and dropped from the spout assembly, generally designated 20, of a bag filling machine, generally designated 12, to fall onto a conventional filled bag conveyor assembly, generally designated 14, to be conveyed thereby through a bag top closure machine, generally designated 13, that is represented by a block in FIG. 2. The bag top closure machine may be of a type for forming a conventional heat sealed bag top closure on plastic bags, or a taped and/or sewn bag top closure.

The bag filling machine 12 includes a pair of uprights 16 that mount upper longitudinal frame members 17, a transverse frame member 18 being extended between frame members 17. A hopper 19 is mounted in a fixed position on the frame members 17 to be directly above the conveyor 14.

A fixed jaw 22 of the spout S is mounted by the longitudinal arms 21 of the spout assembly, generally designated 20. The spout also includes a movable jaw 23 that is mounted by jaw mounts 24, the jaw mounts 24 in turn being pivotally attached by pivot members 25 to the one end portions of arms 21. The movable jaw 23 is movable between a closed position, and an open position abutting against the bag clamp (bag holder) 28 for retaining the upper edge portion of one side wall of a bag therebetween. The bag clamp 28 is mounted by bracket 29 which in turn is attached to the one end portion of arm 21 to depend therefrom. A second bag clamp (bag holder) 30 is mounted by angle irons 31 which in turn are pivotally mounted by a shaft 32, the shaft being mounted by arms 21. A link 33 at one end is pivotally connected at 34 to an angle iron 31 whereby as bag holder 30 is moved to clamp one side wall of the bag against the fixed jaw 22, the movable jaw 23 is moved to clamp the opposite side wall against the bag holder 28. In order to move the angle irons 31 between a bag clamping and a nonclamping (release) position, a piston rod of a two way acting piston cylinder combination 36 is pivotally connected at 37 to a bar 38 that is in turn attached to angle irons 31. The cylinder of combination 36 is pivotally connected by a pivot (not shown) that is mounted by arms 21.

The spout assembly is movable between a position in overhanging / relationship to the conveyor 14 to a position in the direction of the arrow 39 that is longitudinally remote from the conveyor by structure not shown for having a bag clamped thereto. Such structure, together with other details of the spout assembly, will not be further set forth since a more detailed description thereof is set forth in co-pending application Ser. No. 886,800, filed Mar. 15, 1978, that is assigned to the same assignee as the present application, Ser. No. 886,800 being incorporated herein by reference to the extent necessary to understand the operation of the present invention which will now be set forth. Even though the apparatus of this invention may include a separate frame, as illustrated herein, it includes a framework having longitudinal angle irons 41, 42 that are mounted on frame members 17 of the bag filling machine to extend longitudinally more remote from the uprights 16 than the frame members 17. Angle iron 41 dependingly mounts a frame plate 43 while angle iron 42 dependingly mounts a frame plate 44. The lower corner portions of the plates that are remote from uprights 16 have pivot mounts 45 mounted thereon for pivotally mounting a transverse pivot rod 46. The pivot rod 46 extends through a rectangular tubular member 47, an end plate 48 closing one end of the tubular member and one end portion of an arm 49 closing the opposite end of the tubular member. The plate and arm are secured to the tubular member and to the pivot rod to pivot therewith, the tubular member and pivot rod being pivoted as a single unit.

On the end portion of the tubular member adjacent plate 43, plates 51 and 52 are bolted at 53 to be retained in abutting relationship with opposite sides of the tubular member and to permit transverse adjustment of the position thereof along the length of the tubular member. A finger pivot 55 is extended through the tubular member and plates 53, 52 for mounting the one end portion of a finger assembly, generally designated 56, for pivotal movement about an axis that extends perpendicular to the pivot axis of pivot member 46. The finger assembly includes an elongated finger mounting plate 57 that has one end portion adjacent plate 52 and mounted on pivot 55 and a right angle bracket 58 that has one end portion of one leg adjacent plate 51 and mounted on pivot 55 and the other leg attached to plate 57. The one end portion of elongated leg **59*a* of a generally L-shaped finger 59 is secured to the finger mounting plate 57 whereby the other leg 59*b* is located remote from pivot 55** to extend in a downward direction.

In order to pivot the finger assembly about pivot 55 from the solid line "out" position of FIG. 1 to the dotted line "in" position thereof, there is provided a piston cylinder assembly that includes a piston rod 62 pivotally connected at 63 to the finger mounting plate 57, and a cylinder 64 pivotally connected at 65 to a bar 66, the bar being mounted by plate 52 transversely remote from pivot 55. In order to limit the pivotal movement of the finger assembly 56 in the direction of the arrow 67 about pivot 55, a bar 68 is mounted by plate 52, the bar having an adjustment screw 69 threaded therein for abutting against the finger mounting plate 57.

A second finger assembly, generally designated 75 of the same construction as the first finger assembly 56, is mounted in substantially the same manner as the first finger assembly. That is, the second finger assembly is mounted for pivotal movement by a pivot 76 that is parallel to pivot 55 and remote therefrom, pivot 76 being extended through right angle bracket 77, tubular member 47, and finger mounting plate 78. The plate 78 mounts an L-shaped finger 79 and a pivot member 80, the piston rod 81 of a two way acting piston cylinder combination being pivotally connected to pivot 80 and the cylinder 82 being pivotally connected at 83 to a bar 84 that is attached to the plate 85. Plates 85 and 86 are bolted to the tubular member 47 for being retained in a transverse adjusted position thereon, the pivot member 76 being extended through said plates and being located more remote from pivot member 55 than pivot members 65 and 83. The plate 85 mounts a bar 87 which in turn mounts an adjustment screw 88 for limiting the pivotal movement of the finger assembly in the direction of arrow 90 about pivot 76.

Referring in particular to FIG. 3, the structure for pivating the pivot member (finger mount) 46 includes a clevised member 91 having elongated slots 89 through which there is extended studs 90. The studs 90 are mounted by the end portion of arm 49 opposite pivot 46. The clevised member is dependingly mounted by a piston rod 92 of a two way acting piston cylinder combination 92, 93, the cylinder 93 being pivotally mounted at 94 to one end of an arm 95. The mid-portion of the arm 95 is pivotally mounted at 96 to the upper mid-portion of plate 43, the opposite end of arm 95 being pivotally connected at 97 to the piston rod 100 of a two way acting piston cylinder combination 100, 101. The cylinder 101 is pivotally connected at 102 to the plate 43 at a substantially lower elevation than pivot 96. Pivots 94, 96, 97 and 102 have parallel transverse pivot axes.

Referring now in particular to FIGS. 1 and 2, the bag top conveyor assembly, generally designated 106, includes a horizontal mounting plate 107 that is mounted by a longitudinal angle iron 108, the angle iron in turn being mounted by the lower end of frame plate 44. Parallel vertical pulley shafts 110, 111 are rotatably extended through the one end portion of plate 107 and retained in a fixed axial position relative thereto by pulley mounts 109. The lower end portion of each of the pulley shafts has a pulley sheave 112 keyed thereto, a belt 113 being extended around each of the sheaves 112 and around a sheave 114. Each of the sheaves 114 is mounted for rotation by a sheave mount 115 which in turn is dependingly mounted by plate 107. The exit nip of belts 113 is closely adjacent the entry nip of the bag top conveyor of the bag closure machine 13.

In order to drive shaft 111, a pulley sheave 118 is keyed thereto, a belt 119 being extended around sheave 118 and a sheave 120 that is keyed to the output shaft 121 of a motor-reducer combination 122. The combination 122 is mounted on a bracket 123 that in turn is mounted on plate 107. Intermeshing gears 125 are keyed to shafts 110, 111 whereby when shaft 111 is being driven by the motor-reducer combination in one direction, the shaft 110 is drivenly rotated in the opposite angular direction.

Figure 4:
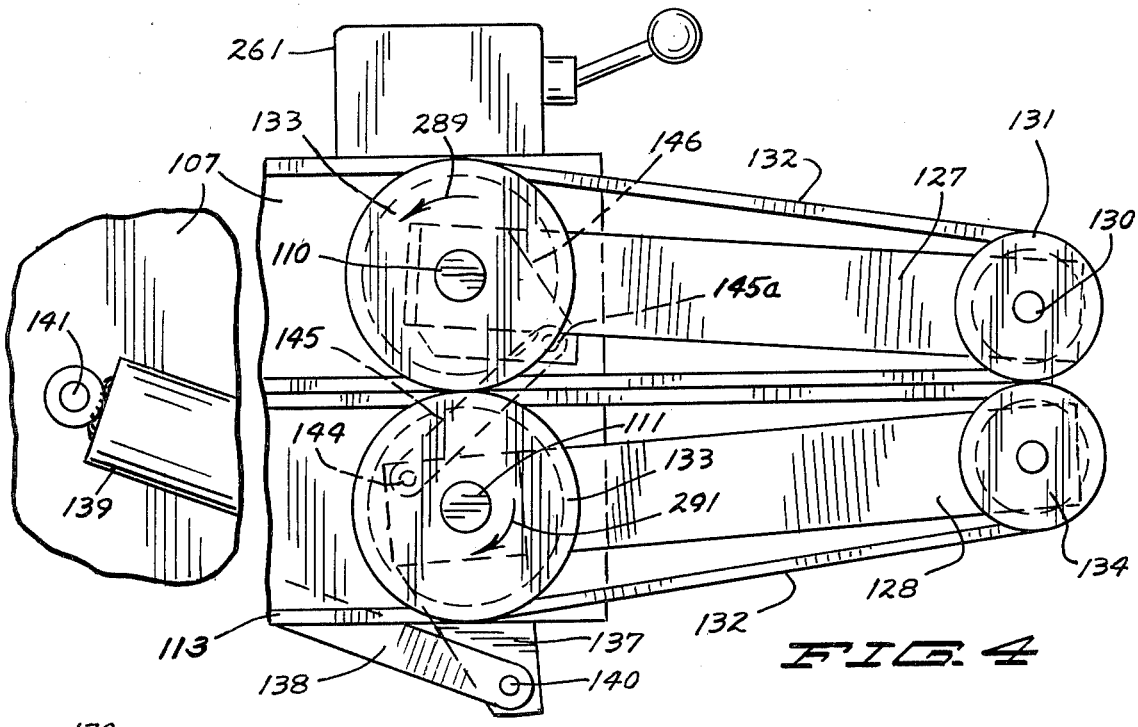
FIG. 4 is a fragmentary view of the swing arm subassembly of the bag top conveyor assembly that is generally taken along the line and in the direction of the arrows 4—4 of FIG. 2.

Swing arms 127, 128 have their one end portion mounted by swing arm mounts 129, one mount being pivotally mounted on shaft 110, in a fixed axial position, and the other on shaft 111. The opposite end of each swing arm dependingly mounts a sheave mount 130 which in turn mounts a pulley sheave 131 and 134 respectively. Around each pulley sheave 131, 134 there is extended a belt 132, the belts also extending around the sheave 133 that is keyed to the respective one of shafts 110, 111. In order to pivot the swing arms about the pulley shafts from the solid line positions of sheaves 131, 134 to the dotted line positions thereof shown in FIG. 1, a plate 137 is bolted to the arm mount 129 that is on shaft 111. The piston rod 138 of a two way acting piston cylinder combination 138, 139 is pivotally connected at 140 to the plate 137 radially outwardly of shaft 111 (see FIG. 4). The cylinder 139 is pivotally mounted by a pivot member 141 that is dependingly attached to plate 107. A link 145 has one end portion pivotally connected at 144 to plate 137, an opposite end of the link being pivotally connected at 145a to a plate 146. The plate 146 is bolted to the swing arm mount 129 that is provided on shaft 110. Pivots 149, 141, 144, and 145a are vertical and parallel to one another, and are located such that in conjunction with the link 145 and the spacing of the pivots from the pulley shafts, as the piston rod 138 is retracted, swing arm 127 is pivoted about shaft 110 in a direction opposite the pivotal movement of arm 128 about shaft 111. Further, swing arm 128 is pivoted through a greater angle than swing arm 127 so as not to interfere with the movement of a bag on a spout assembly as the spout assembly is being moved to generally horizontal in the direction of arrow 290 to a position directly above the filled bag conveyor 14.

Figure 5:
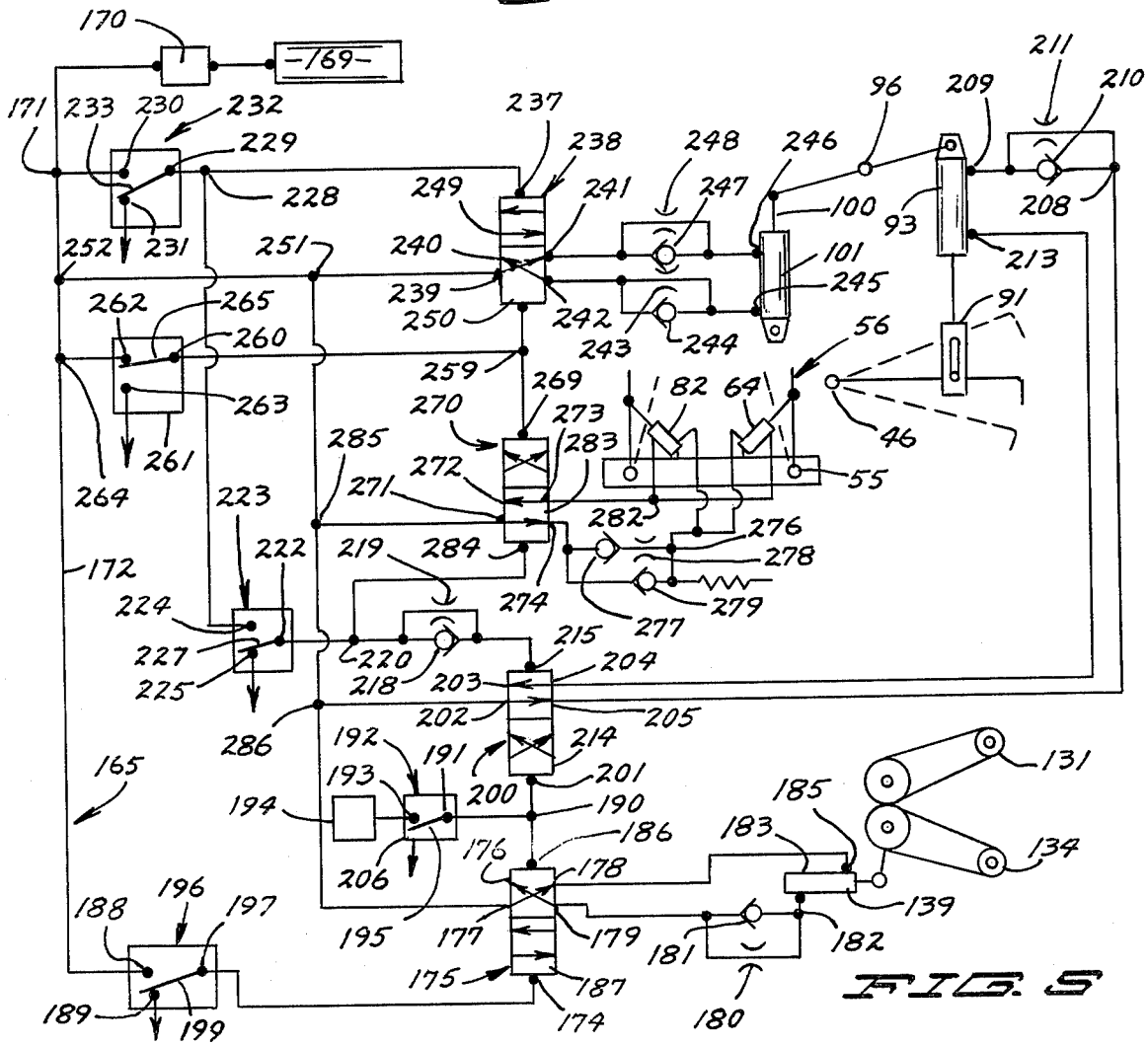
FIG. 5 is a showing of the air control circuitry and components for the apparatus of this invention.

Referring now to FIG. 5, the control circuitry and components, generally designated 165, includes a source of air under pressure 169 that is connected through a shut-off valve 170 to a junction 171 on line 172. Line 172 is connected to the inlet port 188 of the finger down limit switch, generally designated 196. Switch 196 includes a port 197 that is connected to control port 174 of an in-feed belt valve, generally designated 175, an exhaust port 189, and a switch member 199 that is resiliently retained in a position to fluidly connect port 197 to port 189, but when the fingers are in their lowermost pivoted position is moved to break the above-mentioned fluid connection and fluidly connect port 197 to port 188.

The valve 175 includes an inlet port 177, an exhaust port 176, a third port 178, and a fourth port 179. Connected in parallel across port 179 and junction 182 are a check valve 181 and a flow restrictor 180, junction 182 being connected to a port 183 of two way cylinder 139. The cylinder also has a port 185 that is connected by a line to port 178. When air under pressure is applied at control port 186 of valve 175, the valve member 187 thereof moves to a position to fluidly connect port 177 to port 178 and port 179 to port 176, provided it is not already in this position; and when air under pressure is applied to control port 174, valve member 187 moves to break the aforementioned fluid connections and to establish a fluid connection from port 177 to port 179 and from port 178 to the exhaust port.

Control port 186 is connected to a junction 190 that in turn is connected to port 191 of a pneumatic limit switch 192 of the bag filling machine. Switch 192 includes an exhaust port 206, a port 193 that is connected to the air control circuitry 194 of the bag filling machine, and a switch member 195 that is resiliently retained in the open position, but when closed fluidly connects port 193 to port 191 to apply air under pressure from circuitry 194 to junction 190.

Junction 190 is fluidly connected to a control port 201 of the finger up-down valve, generally designated 200. Valve 200 includes an inlet 202, an exhaust port 203, a third part 204, and a fourth port 205. Port 205 is connected to the junction 208, a check valve 210 and a flow restrictor 211 being connected in parallel across junction 208 and the upper port 209 of cylinder 93. The lower port 213 of cylinder 93 is fluidly connected to port 204. Valve 200 includes a valve member 214 that when fluid under pressure is applied at control port 215, the valve member moves to a position to fluidly connect port 202 to port 205 and port 204 to the exhaust port, provided it is not already in this position, and when fluid under pressure is applied at port 201, the valve member moves to break the aforementioned fluid connections and to fluidly connect port 202 to port 204 and port 205 to exhaust port 203.

Connected in parallel across port 215 and junction 220 are a flow restrictor 219 and a check valve 218, junction 220 being connected to a port 222 of a pneumatic finger one-half down limit switch 223. Switch 223 includes a port 224 that is connected to junction 228, an exhaust port 225, and a switch member 227 that is resiliently retained in a position to connect port 222 to port 225 but that when piston rod 100 moves to its extended position, arm 95 operates switch 223 so as to break the connection between ports 222, 225 and fluidly connects port 222 to port 224.

Junction 228 is connected to port 229 of the bag clamped at spout pneumatic switch 232, switch 232 including an inlet port 230 that is connected to junction 171, an exhaust port 231, and a switch member 233 that is resiliently retained in a position to connect port 229 to port 231, but when a bag is clamped to the spout and the spout is above conveyor 14 is moved to fluidly connect port 229 to port 230.

Junction 228 is also connected to control port 237 of the forming finger up-down pneumatic valve, generally designated 238, valve 238 including an inlet port 239 that is connected to a junction 251 which in turn is connected to a junction 252 on line 172. Further, valve 238 includes an exhaust port 240, a third port 241, a fourth port 242 and a control port 250 connected to junction 259. A flow restrictor 248 and a check valve 247 are connected in parallel across port 241 and the upper port 246 of the cylinder 101 while a flow restrictor 243 and a check valve 244 are connected in parallel across the lower port 245 of cylinder 101 and port 242. Additionally, valve 238 has a valve member 249 that when fluid under pressure is applied at port 250 moves to fluidly connect port 239 to port 241 and port 242 to port 240, provided it is not already in this position; and when fluid under pressure is applied to control port 237 is moved to break the above-mentioned fluid connections and fluidly connect port 239 to port 242 and port 241 to port 240.

Junction 259 is connected to port 260 of the belt closed limit switch 261, switch 261 having an inlet port 262 that is connected to a junction 264 on line 172, an exhaust port 263, and a switch member 265 that is resiliently retained in a position to connect port 260 to port 262, but when the swing arm belts move to a spread-apart condition, is moved to break the above-mentioned fluid connection and fluidly connect port 260 to port 263.

Junction 259 is also fluidly connected to control port 269 of the forming finger out-in valve, generally designated 270. Valve 270 includes an inlet port 271, exhaust port 272, a third port 273, a fourth port 274, a valve member 283, and a control port 284 that is connected to junction 220. Connected in series between port 274 and junction 276 is a check valve 277 and a flow restrictor 278 while a variable pressure check valve 179 is connected across junction 176 and port 274 to be in parallel with the combination of check valve 277 and flow restrictor 278.

Junction 276 is connected to ports at the one ends of cylinders 64, 82; the cylinders having ports at the opposite ends that are fluidly connected to a junction 282 which in turn is fluidly connected to port 273. When fluid under pressure is applied at control port 284, valve member 283 moves to a position to fluidly connect port 271 to port 274 and port 273 to port 272, provided it is not already in such a position; and upon fluid under pressure being applied to control port 269, moves to break the above-mentioned fluid connections and to fluidly connect port 271 to port 273 and port 274 to port 272.

Port 271 is connected to a junction 285 which in turn is fluidly connected to junction 251 and junction 286. Junction 286 is fluidly connected to port 202 of valve 200 and port 177 of valve 175.

Each of valves 175, 200, 238 and 270 is of a type that when air under pressure is applied to one control port, its valve member moves as indicated, and remains in the position it moved to until fluid under pressure is applied to the other control port.

The structure of the apparatus having been described, the use thereof will now be set forth.

When the spout assembly 20 is at a location to the right of that shown in FIG. 3, the spout is in a closed condition and a bag is clamped thereto by applying air under pressure to the piston cylinder combination 36 whereupon bag clamp 30 is moved to clamp one side wall of the bag against the fixed jaw 22 and the movable jaw 23 is moved to clamp the other bag side wall against bag clamp 28. At this time the vertical edge portions of the bag are located transversely outwardly of the spout of either side thereof.

At the time the spout is operated to an open condition for clamping the bag on the spout assembly, switch member 265 is closed since the swing arms are presently in their closed together position (solid line position of FIG. 1). As the spout assembly is moved generally in the direction of the arrow 290, it engages an operator (not shown) of the limit switch 192 to move switch member 195 for fluidly connecting port 191 to port 193 for a sufficient period of time that valve member 187 of valve 175 and valve member 214 of valve 200 shift positions, and thereafter the switch member 195 resiliently moves to break the fluid connection between ports 191, 193. This movement of valve member 187 results in port 177 being fluidly connected to port 178 whereupon the piston rod 138 of the swing arm assembly is retracted. The retraction of piston rod 138 results in swing arm 128 being pivoted in the direction of arrow 291 about pulley shaft 111 and swing arm 127 being pivoted in the direction of arrow 289 about pulley shaft 110. Upon swing arm 127 moving to a position indicated in dotted lines in FIG. 1 for pulley sheave 131, the swing arm 127 engages the operator of the limit switch 261 whereby port 260 is connected to exhaust port 263. Due to this movement of the swing arms, swing arm 128 is moved to a position out of the path of travel of a bag that is clamped on the spout assembly and being moved therewith.

At the same time that air under pressure was applied to control port 186 to move valve member 187 in the manner set forth in the preceding paragraph, air under pressure is applied to control port 201 whereby valve member 214 moves to fluidly connect port 202 to port 204. This results in air under pressure being applied to the lower end of the cylinder 93 whereupon piston rod 92 is retracted. Since at this time the studs 90 are in the lower end of slots 89, the arm 49 is moved to pivot the pivot rod 46 and the structure mounted thereon in the direction of the arrow 293 about the pivot axis of the pivot rod 46. This elevates finger portions 59*b* and 79*b* from the upper dotted line position to the solid line position of FIG. 3 since at this time piston rod 100 is in its retracted position.

The limit switch 232 is mounted on either the bag filling machine frame, or the frame of the apparatus of this invention, in a position to be closed by one of the members of the spout assembly upon the spout assembly with a bag clamped thereto having moved to its FIG. 3 position beneath the hopper and is retained in a closed position as long as the spout assembly remains in this position with a bag clamped thereto. When the limit switch 232 is closed, port 230 is fluidly connected to port 229. This applies air under pressure to control port 237 of the bag clamped at spout valve 238 whereby valve member 249 is moved to fluidly connect port 239 to port 242 and as a result the piston rod 100 is moved in the direction of the arrow 295 to its extended position. This pivots arm 95 in the direction of arrow 296 about pivot member 96 whereby the piston cylinder combination 92, 93 moves downwardly in the direction of the arrow 297. Due to the length of slots 89, the finger end portions 59*b*, 79*b* are free to drop into the bag mouth of the bag that is clamped on the bag spout, the fingers pivoting in the direction opposite arrow 293 about the pivot axis of pivot member 46. The amount of pivotal movement in this direction is limited by the finger portions 59*a*, 79*a* abutting against the adjacent bag top edge 15*c* that in part defines the bag mouth. The position of the fingers in abutting against the bag top edge of the bag clamped on the spout is indicated by the upper dotted line position in FIG. 3, finger portion 59*b* being between the spout and bag top trailing edge 15*b* and finger portion 79*b* being between the spout and bag top leading edge portion 15*a*.

When the piston rod 100 is fully extended, arm 95 engages the operator of limit switch 223 to close switch member 227 and thereby fluidly connect port 224 to port 222. This applies fluid under pressure to control port 284 of the finger out-in valve 270 and the control port 215 of the valve 200. The application of fluid under pressure to control port 284 results in valve member 283 shifting to fluidly connect port 271 to port 274 whereby the piston rods 62, 81 are moved to their extended condition. This moves the fingers to their solid line out position of FIG. 1, the spreading movement of the fingers being limited by the dimension of the bag mouth. The fingers portions 59*b*, 79*b* engage the bag mouth portion under sufficient force to retain the bag mouth portion in upright condition and the bag top leading and trailing edges in direct alignment with the path of travel between belts 113.

The flow restrictor 219 delays the build up of fluid under pressure at port 215 for moving valve member 214 until the fingers have been moved to their spread-apart (out) condition, and thereafter valve member 214 shifts to fluidly connect port 202 to port 205. This applies fluid under pressure to the upper end of cylinder 93 whereby piston rod 92 is extended (moved in the direction of arrow 297). Since at this time the fingers are abutting against the bag mouth top edge 15*c*, the fingers remain in approximately the uppermost dotted line position of FIG. 3 even though clevised member 91 is moved to a position that the lower ends of slots 89 are spaced below studs 90 while the upper edges of the slots are closely adjacent said studs.

After the hopper 19 has dumped its charge through the spout S to fill the bag, the control circuitry of the bag filling machine operates the piston cylinder combination 36 to move the movable spout 23 to its closed position and bag clamp 30 away from the fixed jaw 22. As a result the bag drops to the conveyor 14 and limit switch 232 opens. Further. the bag filling machine control circuitry operates the spout assembly to move generally in the direction of the arrow 39 away from the position shown in FIG. 3, switch member 195 remaining open while the spout assembly returns to a position to have another bag clamped to the spout.

At the time the filled bag is released from the spout assembly to drop onto the conveyor 14, the fingers are free to pivot under gravity from their uppermost dotted line position to their lowermost dotted line position of FIG. 3 due to the lost motion connection provided by the elongated slots 89. Thus, at the time the bag is being supported by the conveyor 14, the fingers are in their lowermost solid line position of FIG. 3 and retain the bag top in an upright, noncollapsed condition, the downwardly pivotal movement of the fingers being limited by the studs abutting against the lower ends of slots 89.

When the fingers are moved to their lowermost position, the arm 49 engages the operator of limit switch 196 to move switch member 199 for fluidly connecting port 188 to port 197 and thus apply fluid under pressure to control port 174. This operates valve member 187 so that fluid under pressure is applied from port 177 to port 183 of cylinder 139 whereupon the piston rod 138 is moved to its extended position. This pivots the belts from the spread-apart position to their together position shown in FIG. 4. Since finger portion 79b is longitudinally intermediate shafts 110, 111 and sheaves 134, 131, as the belts move together, they engage the leading edges portion of the bag top at a slightly lower elevation than the lower ends of finger portions **59*b*, 79*b***.

As the swing arms move toward their together (closed) position, swing arm 127 moves away from the operator of limit switch 261 whereby its switch member 265 is resiliently returned to a closed position to apply air under pressure to control ports 269 and 250. The application of fluid under pressure at port 269 shifts valve member 283 to apply air under pressure to the ends of cylinders 64, 82 for retracting their piston rods, the flow restrictor 278 controlling the exhaust of air from the cylinder 64, 82 so that the finger assemblies retain the bag top upright in direct alignment with the path of travel through belts 113 until belts 132 engage the leading portion of the bag top to hold it upright. The application of fluid under pressure at control port 250 results in valve member 249 moving to a position that fluid under pressure is applied to the upper end of cylinder 101, and as a result cylinder 93 is moved upwardly to pivot the fingers in a direction to move the finger portions **59*b*, 79*b* out of the bag mouth. Flow restrictor 243 controls the rate of exhaust of cylinder 101 so that the fingers are not completely withdrawn from the top edge portion of the filled bag until belts 132 conveyingly engage the bag top. The retraction of piston rod 100 results in switch member 227 opening. At the time the fingers are completely withdrawn, a substantial portion of the bag top is being supportingly retained in an upright condition by the inner runs of conveyor belts 132, the bag top in passing between the conveyor belts 132 being moved to be conveyed between the conveyor belts 113. The discharge nip of the conveyor belt 113** opens to the conveyor belts or rollers (not shown) of the bag top closing machine.

Thereafter the switch member 195 of limit switch 192 is operated to a closed condition by the spout assembly moving to the position of FIG. 1 and the cycle of operation is repeated.

By using the apparatus as mentioned, the bag top portion of the filled bag is retained in a straightened upright condition as the bag falls from the hopper spout assembly onto a filled bag conveyor assembly, and until after the swing arm belts are moved to a closed condition to retain the leading edge portion of the bag top in an upright condition. Thus, prior to the fingers being withdrawn, a sufficient portion of the bag top is being supportingly held by the inner runs of belts 132 that the remainder of the bag top will be moved forwardly by the belts 132 at a proper elevation even though the fingers are withdrawn before the trailing edge portion of the bag top has passed through the entry nip of belts 132. That is, even though the trailing edge of the bag should bend prior to entry between the belts 132 as the bag top moves between the belts 132, the portions at an elevation below the belts bend back to be in an upright condition. Thus the bag top is positively engaged from before the bag is released by the spout assembly until it is moved between belts 113. Even though the invention has been described with reference to a spout assembly that is moved through a horizontal path, by properly locating limited switches 192, 232, the apparatus of this invention can be used with other types of bag filling machines, including ones where the spout is not moved horizontally or vertically other than for the relative movement of the bag clamps and spout jaws between a bag clamping and a bag release position.

What is claimed is:

1. Bag top forming and retaining apparatus for a bag having top edges defining a bag mouth, opposite side wall portions, a leading vertical edge and a trailing vertical edge comprising a frame, a transverse pivot member pivotally mounted on the frame for pivotal movement about a transverse axis, a first and a second finger assembly each having a first end portion and a second end portion, first pivot means mounting the first finger assembly first end portion on the pivot member for pivotal movement about a first axis that is about at right angles to the transverse pivot axis, second pivot means mounting the second finger assembly first end portion on the pivot member for pivotal movement about a pivot axis that is substantially parallel to the pivot axis of the first pivot assembly, operable first power means for pivoting the finger assemblies about their pivot axis between an in position and an out position that the finger assembly second end portions are more remote from one another than they are in their in positions, operable second power means for pivoting the pivot member about its pivot axis between a first position that the finger assembly second end portions are at a first elevation and a second position at a higher elevation than the first elevation, a bag top conveyor assembly that includes a first bag top conveyor member and a second bag top conveyor member, means for mounting the bag top conveyor members for movement between a spread apart condition and a together position to conveyingly engage a bag top and operable third power means for moving the conveyor members between their spread apart and together positions, the conveyor members each having first and second end portions and an intermediate portion, the conveyor members in their together position having their intermediate portions adjacent the second finger assembly second end portion when the second finger assembly is in its second out position, and their first end portions more remote from the first finger assembly than their second end portions, and control means for operating the power means to move the conveyor members to their together position after the finger assemblies in their out position have pivoted to their first position about the transverse axis, and after operating the conveyer members power means to move the conveyor members toward their together position, operate the other two power means to move the finger assemblies to their in and second elevation positions and thereafter to their out position.

2. The apparatus of claim 1 further characterized in that the second power means includes a first arm having a first end portion connected to the pivot member and a second end portion, a second arm having first and second end portions and an intermediate portion, means having a pivot axis for pivotally connecting the second arm intermediate portion to the frame, fourth power means connected to the frame and to the second arm first end portion for selectively pivoting the second arm about the pivotal connecting means axis and means for connecting the first arm second end portion to the second arm second end portion.

3. The apparatus of claim 2 further characterized in that the last mentioned means includes an operable two way acting piston cylinder combination having a piston rod and a cylinder for pivotally moving the first arm about the transverse axis independent of the pivotal movement of the second arm, means for pivotally connecting one of the cylinder and the piston rod to the second arm second end portion, and means for connecting the other of the cylinder and the piston rod to the first arm second end portion.

4. The apparatus of claim 3 further characterized in that the last mentioned means includes a stud mounted on the first arm second end portion and lost motion connecting means for connecting the stud to the piston cylinder combination to permit limited movement of the first arm second end portion relative the piston cylinder combination.

5. The apparatus of claim 4 further characterized in that the lost motion means comprises a bracket having a slot elongated in the direction of movement of the piston rod in the cylinder, the stud being extended into the slot.

6. The apparatus of claim 4 further characterized in that the control means includes means to operate the fourth power means and piston cylinder combination for pivoting the pivot member to the finger assembly first elevation, thence operate the fourth power means to pivot the second arm member a sufficient amount in a direction to permit the finger assemblies moving to an elevation intermediate the finger assemblies first and second elevations, thereafter operate the first power means to move the finger assemblies from their in position to their out position and after the finger assemblies are in their out position, operate the piston cylinder combination to permit the finger assemblies moving from their intermediate elevation to their first elevation.

7. An apparatus for forming the bag top of a bag that has top edges defining a bag mouth and leading and trailing edge portions as the filled bag falls to a filled bag conveyor assembly from a bag filling machine that has a spout that includes spout jaws relatively movable between an open position and a closed position, and bag clamps movable relative the spout jaws between a first position for clampingly retaining an empty bag to have a charge of product discharged through the spout jaws in their open position and a second position to release the filled bag to fall to the filled bag conveyor assembly to be conveyed thereby, comprising a first and a second finger assembly each having bag top engagable first end portions and second end portions, a framework, an elongated pivot member mounted on the framework for pivotal movement about a first pivot axis, first and second pivot means mounted on the pivot member for mounting the first and second finger assemblies second end portions for pivotal movement about second and third pivot axes, respectively, that are located in planes that are generally perpendicular to the first pivot axis, first operable power means connected to the finger assemblies for pivoting the finger assemblies between an in first position and a second out position that the first assemblies first end portions are more remote from one another than they are in their in position, operable second power means for pivoting the pivot member between a first position that the finger assemblies first end portions are at a higher elevation than the bag top edges of the clamped bag, a second position that the finger assemblies first end portions extend to a lower elevation than the bag top edges of a clamped bag and a third position that the finger assemblies first end portions extend through the bag mouth of the filled bag on the filled bag conveyor assembly and control means for operating the power means for moving the finger assemblies to their in position and the pivot member to its first position, then the pivot member to its second position so that the finger assemblies first end portions extend through the bag mouth of the clamped bag, thence move the finger assemblies to their out position so that the finger assemblies first end portions engage the bag top leading and trailing end portions to form the bag top, thereafter permit the pivot member moving to its third position to retain the bag top in its formed condition as the filled bag falls to the filled bag conveyor assembly, and thence to move the finger assemblies to their in position and the pivot member to its first position to withdraw the finger assemblies first end portions from the bag mouth of the filled bag on the filled bag conveyor assembly.

8. The apparatus of claim 7 further characterized in that it includes a bag top conveyor assembly mounted on the framework, the bag top conveyor assembly including a first bag top conveyor member, a second bag top conveyor member, operable means mounted on the framework for mounting the conveyor members on the framework and moving the conveyor members between a spread apart first position and a together second position to conveyingly engage the bag top of the filled bag on the filled bag conveyor assembly and third operable power means for operating conveyor member mounting and moving means to move the conveyor members between their first and second positions, the control means including means for operating the third power means for operating the conveyor member moving means to move the conveyor members from their spread apart position to their together position after the pivot member has moved to its third position and prior to the finger assemblies have been moved to their in position and the pivot member from its third position to its first position to conveyingly engage the bag top of the filled bag on the filled bag conveyor assembly.

9. The apparatus of claim 8 further characterized in that conveyor member mounting and moving means includes a pair of parallel pulley shafts rotatably mounted on framework, and a pair of elongated swing arms having first end portions pivotally mounted on the pulley shafts and second end portions remote from the pulley shafts, and fourth power means for drivingly rotating the shafts in opposite directions, that the third power means includes a piston cylinder combination connected between the framework and one of the swing arms for selectively pivoting the one swing arm about its pulley shaft and linkage means connected to the swing arms for pivoting the other swing arm to move the swing arms second end portions away from one another as the piston cylinder combination pivots the one arm in one angular direction and the arm second end portions toward one another when the one arm is pivoted in the opposite angular direction.

10. The apparatus of claim 9 further characterized in that the linkage means comprises a link having first and second end portions and means for connecting the link end portions to the first and second arms, respectively, for pivoting the other arm through a greater angle than the one arm.

11. The apparatus of claim 9 further characterized in that the conveyor members each include a pulley sheave mounted on the respective pulley shaft to be drivenly rotated thereby, an idler pulley sheave mounted on the respective arm second end portion and an endless belt mounted on the pulley sheaves for the respective arm, the belts having inner runs for conveyingly engaging the bag top of a filled bag on the filled bag conveyor assembly when the conveyor members are in their together position.

12. The apparatus of claim 11 further characterized in that the conveyor belts in the conveyor member together position having an exit nip remote from the finger assemblies first end portions when the finger assemblies are in their out position and the pivot member is in its third position and an entry nip that is generally opposite one of the finger assemblies first end portion from the exit nip.

13. The apparatus of claim 12 further characterized in that it includes a second bag top conveyor assembly that has first and second idler pulley sheaves mounted on the framework, first and second pulley sheaves mounted on the pulley shafts for being drivenly rotated thereby, and first and second belts mounted on the last mentioned pulley sheaves and the last mentioned idler pulley sheaves and having inner runs to conveyingly engage the filled bag on the filled bag conveyor assembly, and an entry nip to conveying receive the bag top of filled bag that has been conveyingly engaged by the first mentioned belts inner runs.

14. The apparatus of claim 7 further characterized in that the second operable power means includes an elongated arm having a first end portion connected to the pivot member and a second end portion, a two way acting piston cylinder combination having a first end and a second end, means for mounting the combination first end on the framework and means for connecting the combination second end to the arm second end portion, the combination being operable for moving the arm second end portion between a first position and a second position that is more clearly adjacent the combination first end than its first position.

15. The apparatus of claim 14 further characterized in that the last mentioned means includes a bracket having an elongated slot and a stud mounted on the arm second end portion and extended into the slot for being moved by the bracket and being movable the length of the slot relative thereto.

16. The apparatus of claim 14 further characterized in that means for mounting the combination first end portion on the framework includes operable fourth power means mounted on the framework for selectively moving the piston cylinder combination to a first position that when the combination has moved the arm second end portion to it second position the pivot member is in its first position and a second position to permit the pivot member moving to its third position when the combination has moved the second arm member second end portion to its first position.

17. The apparatus of claim 16 further characterized in that the fourth power means includes a second arm having an intermediate portion pivotally mounted on the framework, a second end portion pivotally mounting the first combination first end, and a first end portion, and a two way acting second piston cylinder combination having a first end pivotally mounted on the framework and a second end portion pivotally connected to the second arm first end portion.

18. The apparatus of claim 17 further characterized in that the first power means includes piston cylinder means connected between the framework and the finger assemblies for moving the finger assemblies between their in and out positions, that the finger assemblies each includes a generally L-shaped finger having one leg remote from the pivot member and that there is provided bag top conveyor for conveyingly engaging the bag top of the filled bag on the filled bag conveyor assembly prior to the finger assemblies being moved from their out position, pivot member third position to their in position, pivot member first position.

19. Apparatus for forming the bag top of a bag that has top edges defining a bag mouth, leading and trailing edge portions, and opposite top side wall portions, and retaining the bag top in a formed condition as the bag falls to a filled bag conveyor assembly from a bag filling machine having a spout that includes spout jaw relatively movable between an open position and a closed position and bag clamp movable relative the spout jaws between a first position for the clampingly retaining an empty bag to have a charge of product discharged through the spout jaws in their open position and a second position to release the filled bag to fall to the filled bag conveyor assembly, comprising a framework, a bag top conveyor assembly mounted on the framework above the filled bag conveyor assembly, the bag top conveyor assembly including a first conveyor member and a second conveyor member, operative first means mounted on the framework for mounting the conveyor members and moving the conveyor members between a spread apart position, and a together position to conveyingly engage the bag top of a filled bag on the filled bag conveyor assembly, operable second means mounted on the framework for engaging the bag top and forming the bag top of a bag that is being clampingly retained by the clamps and positively retaining the bag top in the formed condition as the bag falls to the filled bag conveyor assembly and until the conveyor members conveyingly engage the bag top of the filled bag on the filled bag conveyor assembly and thence moving away from the bag top, and control means for operating the second means to engage the bag top while the conveyor members are in their spread apart condition and move the second means away from the bag top after the conveyor members have moved from their spread apart position toward their together position and the first means to move the conveyor members to their together position after the filled bag has been released to fall to the filled bag conveyor assembly.

20. The apparatus of claim 19 further characterized in that the second means includes third means for abuttingly engaging the bag top leading edge portion, fourth means for abuttingly engaging the bag top trailing edge portion, movable fifth means mounting the third and fourth means on the framework for movement between a first elevation above the bag top edges of a bag being clampingly retained by the clamps, a second intermediate elevation, and a third elevation engaging the bag top of a filled bag on the filled conveyor assembly, an in position, and an out position that the third and fourth means are more remote from one another than they are in their in position, operable sixth means for moving the third and fourth means between their in and out position, and operable seventh means for moving the fifth means and the third and fourth means between the three elevations, the control means including means for operating the sixth and seventh means to move fifth means and third and fourth means from their first elevation to their second elevation while the third and fourth means are in their in positions, the third and fourth means to their out position while they are at their second elevation and retain them in their apart position while they move from the second elevation to their third elevation, and thereafter move the third and fourth means from their out position at the third elevation to their in position at the first elevation.

21. The apparatus of claim 20 further characterized in that the seventh means includes a first arm pivotally mounted on the framework, operable first power means mounted in the framework and connected to the arm for selectively pivoting the arm between a first pivotal position and a second pivoted position and means for connecting the arm to the fifth means to move the fifth means.

22. The apparatus of claim 21 further characterized in that the means for connecting the arm to the fifth means includes a second arm connected to the fifth means for moving the fifth means, and operable second power means mounted on the arm for movement therewith for selectively moving the second arm independent of the movement of the first arm.

23. The apparatus of claim 21 further characterized in that the bag top conveyor assembly includes endless belt conveyor means for receiving a bag top that has been conveyingly engaged by the conveyor members, the conveyor members comprising first and second driven endless belts having inner runs for abutting against the bag top side walls when the conveyor members are in their together position.

24. The apparatus of claim 23 further characterized in that the third means includes a generally L-shaped finger having one leg extendable through the bag mouth to abut against the leading edge portion when the third means is in its out position at the second elevation and that the fourth means includes a generally L-shaped finger having one leg extendable through the bag mouth to abut against the trailing edge portion when the fourth means is in its out position at the second elevation.

* * * * *

UNITED STATES PATENT AND TRADEMARK OFFICE

CERTIFICATE OF CORRECTION

PATENT NO. : 4,214,417

DATED : 7/29/80

INVENTOR(S) : Gaylerd M. Lieder

It is certified that error appears in the above-identified patent and that said Letters Patent are hereby corrected as shown below:

ABSTRACT - line 5 from the bottom, change "thus" to --thence--.

Column 2, line 64, delete "/"

Column 6, line 60, change "179 " to --279--.

Column 6, line 61, change "176" to --276--.

Column 13, line 61, change "clearly" to --closely--.

Signed and Sealed this

*Twenty-eighth* Day of *October 1980*

[SEAL]

*Attest:*

SIDNEY A. DIAMOND

*Attesting Officer*

*Commissioner of Patents and Trademarks*